US008554279B2

(12) United States Patent
Otaka

(10) Patent No.: US 8,554,279 B2
(45) Date of Patent: Oct. 8, 2013

(54) CIRCUIT FOR DRIVING LIGHT-EMITTING ELEMENT, AND CELLULAR PHONE

(75) Inventor: Nobuyuki Otaka, Kadoma (JP)

(73) Assignees: Semiconductor Components Industries, LLC., Phoenix, AZ (US); Sanyo Semiconductor Co., Ltd., Ora-Gun, Gunma (JP)

( * ) Notice: Subject to any disclaimer, the term of this patent is extended or adjusted under 35 U.S.C. 154(b) by 643 days.

(21) Appl. No.: 12/269,566

(22) Filed: Nov. 12, 2008

(65) Prior Publication Data

US 2009/0137282 A1 May 28, 2009

(30) Foreign Application Priority Data

Nov. 16, 2007 (JP) ..... 2007-298140

(51) Int. Cl.
*H04M 1/00* (2006.01)

(52) U.S. Cl.
USPC ..... 455/566; 455/572; 345/211; 345/76; 345/83; 345/204; 345/215; 257/379; 257/342; 257/345; 257/350; 257/355; 257/356; 257/358; 257/360; 257/368; 257/372

(58) Field of Classification Search
USPC ..... 455/566, 572; 257/379, 342, 345, 349, 257/350, 355, 356, 358, 360, 363, 368, 371, 257/372, 382; 345/76–83, 204–215
See application file for complete search history.

(56) References Cited

U.S. PATENT DOCUMENTS 6,052,076 A * 4/2000 Patton et al. ..... 341/144
6,950,079 B2 9/2005 Inoue
7,145,295 B1 * 12/2006 Lee et al. ..... 315/291
7,312,783 B2 * 12/2007 Oyama ..... 345/102
7,423,389 B2 * 9/2008 Lee ..... 315/308
7,495,397 B2 * 2/2009 Okabe ..... 315/169.1
7,714,520 B2 * 5/2010 Liu ..... 315/291
7,724,219 B2 5/2010 Ikeda (Continued)

FOREIGN PATENT DOCUMENTS

JP 63-10867 A1 1/1988
JP 5-063283 A 3/1993

(Continued)

OTHER PUBLICATIONS esp@cenet patent abstract for Japanese Publication No. 2005011895, Publication date Jan. 13, 2005 (1 page).

(Continued)

*Primary Examiner* — Andrew Wendell
*Assistant Examiner* — Ganiyu A Hanidu
(74) *Attorney, Agent, or Firm* — Osha Liang LLP

(57) ABSTRACT

A boosting circuit unit supplies a boosting voltage to one terminal of a backlight. A boosting comparator compares a voltage applied to the other terminal of the backlight with a predetermined reference voltage value, and outputs a comparison result as a feedback signal reflecting the boosting voltage to the boosting circuit unit. An LED driver unit is connected to the other terminal of the backlight and supplies drive current to the backlight. An acquisition unit acquires a PWM signal, which is generated based on the content of a video signal and can be used to change the luminance of the backlight. An LPF unit outputs a time-averaged signal of the acquired PWM signal as a control signal to be supplied to the LED driver unit.

2 Claims, 3 Drawing Sheets

(56) References Cited

U.S. PATENT DOCUMENTS

| | | | | |
|---|---|---|---|---|
| 7,808,474 | B2 * | 10/2010 | Mizuno et al. | 345/102 |
| 2002/0105373 | A1 * | 8/2002 | Sudo | 327/538 |
| 2003/0098861 | A1 * | 5/2003 | Nakatsuka et al. | 345/212 |
| 2003/0117422 | A1 * | 6/2003 | Hiyama et al. | 345/690 |
| 2004/0251854 | A1 * | 12/2004 | Matsuda et al. | 315/291 |
| 2005/0168490 | A1 * | 8/2005 | Takahara | 345/690 |
| 2005/0259091 | A1 * | 11/2005 | Sakamoto | 345/204 |
| 2006/0082352 | A1 * | 4/2006 | Warita et al. | 323/272 |
| 2007/0080905 | A1 * | 4/2007 | Takahara | 345/76 |
| 2008/0001070 | A1 * | 1/2008 | Nakamura et al. | 250/214 R |
| 2008/0290906 | A1 * | 11/2008 | Chou et al. | 327/77 |
| 2009/0002403 | A1 * | 1/2009 | Barnhoefer et al. | 345/690 |
| 2009/0085538 | A1 | 4/2009 | Miguchi et al. | |

FOREIGN PATENT DOCUMENTS

| | | | |
|---|---|---|---|
| JP | 2002-231470 | A | 8/2002 |
| JP | 2005-11895 | | 1/2005 |
| JP | 2005-099349 | A | 4/2005 |
| JP | 2006-137144 | A | 6/2006 |
| JP | 2006-319057 | A | 11/2006 |
| JP | 2007079501 | A | 3/2007 |
| JP | 2007148008 | A | 6/2007 |
| WO | 2006080364 | A1 | 8/2006 |

OTHER PUBLICATIONS

Notice of Grounds for Rejection for Japanese Patent Application No. 2007-298140 mailed Jul. 3, 2012, with English translation thereof (6 pages).

Espacenet, Patent Abstract for Japanese Publication No. 2006-319057 published Nov. 24, 2006 (1 page).

Espacenet, Patent Abstract for Japanese Publication No. 2002-231470 published Aug. 16, 2002 (2 pages).

Espacenet, Patent Abstract for Japanese Publication No. 2005-099349 published Apr. 14, 2005 (1 page).

Espacenet, Patent Abstract for Japanese Publication No. 5-063283 published Mar. 12, 1993 (1 page).

Espacenet, Patent Abstract for Japanese Publication No. 2006-137144 published Jun. 1, 2006 (1 page).

Espacenet, Patent Abstract for Japanese Publication No. 63-10867 published Jan. 18, 1988 (1 page).

Notice of Grounds for Rejection in corresponding Japanese application No. 2007-298140 dated May 28, 2013 (7 pages).

Espacenet Abstract Publication No. WO2006080364 A1 dated Aug. 3, 2006 (1 page).

Espacenet Abstract Publication No. JP2007079501 a dated Mar. 29, 2007 (1 page).

Espacenet Abstract, Publication No. JP2007148008 A dated Jun. 14, 2007 (1 page).

* cited by examiner

CIRCUIT FOR DRIVING LIGHT-EMITTING ELEMENT, AND CELLULAR PHONE

PRIORITY INFORMATION

This application claims priority to Japanese Patent Application No. 2007-298140, filed on Nov. 16, 2007, which is incorporated herein by reference in its entirety.

BACKGROUND OF THE INVENTION

1. Field of the Invention

The present invention relates to a light-emitting element driving circuit and a cellular phone, and more particularly to a light-emitting element driving circuit capable of changing the luminance of a light-emitting element, and a cellular phone incorporating the light-emitting element driving circuit.

2. Description of the Related Art

A trend of recent cellular phones is enabling users to view TV broadcasting programs and other videos on a main liquid crystal display screen. To this end, cellular phones are required to incorporate a light-emitting element driving circuit that can change the luminance of a backlight equipped in the liquid crystal display device. Meanwhile, excessive current consumption by the backlight of the main liquid crystal display device is a problem to be solved. To this end, there is a conventional method for solving the problem by changing the luminance of the backlight of the liquid crystal display device according to the content of a video signal. More specifically, the method includes enhancing the brightness by increasing the luminance of the backlight when the video signal is a bright image and enhancing the darkness by decreasing the luminance of the backlight when the video signal is a dark image. In this manner, the light-emitting element driving circuit is required to reduce wasteful current consumption and realize a long-term use of the battery.

For example, a light-emitting element driving circuit discussed in Japanese Laid-Open Patent Application No. 2005-11895 is a light emitting diode (LED) driving circuit including a battery that supplies drive current to an LED. A constant current circuit, which is disposed on an anode side or a cathode side of the LED, controls a current value of the current flowing through the LED to have a predetermined target value. A resistor is connected to the cathode side of the LED and a downstream side of the constant current circuit. When a sum of a voltage drop across the LED in a forward direction, a drive voltage of the constant current circuit attaining the predetermined target value, and a terminal voltage of the resistor applied when the predetermined target value is attained, is a predetermined voltage, the voltage of the battery varies according to a residual capacity within a range including the predetermined voltage value. A boosting circuit, which is connected between the battery and the LED, outputs a boosted battery voltage greater than the predetermined voltage when a switch provided therein is turned on, and directly outputs the battery voltage when the switch is turned off. A control circuit, which is connected to the constant current circuit, determines whether the battery voltage is greater than the predetermined voltage and turns the switch of the boosting circuit on only when the battery voltage is smaller than the predetermined voltage.

SUMMARY OF THE INVENTION

In the use of the above-described arrangement, a pulse width modulation (PWM) signal corresponding to the content of a video signal may be used to change the current value of the constant current circuit connected to the cathode side of the light-emitting element (LED). The luminance of the backlight equipped in the liquid crystal display device can be changed by boosting the voltage applied to the anode side of the light-emitting element to a predetermined constant voltage. In this case, ON voltage of the light-emitting element is variable depending on process differences. Boosting efficiency is reduced because of the necessity of taking such differences into consideration in setting a constant voltage for the boosting operation.

An object of the present invention is to provide a light-emitting element driving circuit capable of efficiently changing the luminance of a light-emitting element, and to provide a cellular phone incorporating the light-emitting element driving circuit.

According to an aspect of the present invention, a light-emitting element driving circuit includes a power source circuit unit configured to supply a boosting voltage to one terminal of a light-emitting element, a driving circuit unit connected to the other terminal of the light-emitting element and configured to supply drive current to the light-emitting element, an acquisition unit configured to acquire a PWM signal, which is generated based on the content of a video signal and can be used to change the luminance of the light-emitting element, and a time-averaging circuit unit configured to output a time-averaged signal of the acquired PWM signal as a control signal to be supplied to the driving circuit unit.

According to another aspect of the present invention, a light-emitting element driving circuit includes a power source circuit unit configured to supply a boosting voltage to one terminal of a light-emitting element, a voltage comparison circuit unit configured to compare a voltage applied to the other terminal of the light-emitting element with a predetermined reference voltage value and output a comparison result as a feedback signal reflecting the boosting voltage to the power source circuit unit, a driving circuit unit connected to the other terminal of the light-emitting element and configured to supply drive current to the light-emitting element, an acquisition unit configured to acquire a PWM signal, which is generated based on the content of a video signal and can be used to change the luminance of the light-emitting element, and a time-averaging circuit unit configured to output a time-averaged signal of the acquired PWM signal as a control signal to be supplied to the driving circuit unit.

According to the above-described light-emitting element driving circuit, the power source circuit unit supplies the boosting voltage to one terminal of the light-emitting element. The voltage comparison circuit unit compares the voltage applied to the other terminal of the light-emitting element with the predetermined reference voltage value, and outputs the comparison result as the feedback signal reflecting the boosting voltage to the power source circuit unit. The driving circuit unit is connected to the other terminal of the light-emitting element and supplies drive current to the light-emitting element. The acquisition unit acquires the PWM signal, which is generated based on the content of the video signal and can be used to change the luminance of the light-emitting element. Also, the time-averaging circuit unit outputs a time-averaged signal of the acquired PWM signal as a control signal to be supplied to the driving circuit unit.

In the light-emitting element driving circuit according to the present invention, it is desired that the other terminal of the light-emitting element is a cathode electrode.

In the light-emitting element driving circuit according to the present invention, it is desired that the time-averaging circuit unit is constituted by a low-pass filter.

In the light-emitting element driving circuit according to the present invention, it is desired that the drive current supplied from the driving circuit unit to the light-emitting element has a current value obtained by subtracting a current value derived from the time-averaged signal from a predetermined reference current value.

In the light-emitting element driving circuit according to the present invention, it is desired that the light-emitting element driving circuit includes a semiconductor chip and a resistor element disposed on the semiconductor chip as an external circuit element, wherein the resistor element has a resistance value that can be used to set the current value derived from the time-averaged signal.

The cellular phone according to the present invention is a cellular phone including a light-emitting element driving circuit configured to drive a light-emitting element that illuminates an image display apparatus. The light-emitting element driving circuit includes a power source circuit unit configured to supply a boosting voltage to one terminal of the light-emitting element, a driving circuit unit connected to the other terminal of the light-emitting element and configured to supply drive current to the light-emitting element, an acquisition unit configured to acquire a PWM signal, which is generated based on the content of a video signal and can be used to change the luminance of the light-emitting element, and a time-averaging circuit unit configured to output a time-averaged signal of the acquired PWM signal as a control signal to be supplied to the driving circuit unit.

The cellular phone according to the present invention is a cellular phone including a light-emitting element driving circuit configured to drive a light-emitting element that illuminates an image display apparatus. The light-emitting element driving circuit includes a power source circuit unit configured to supply a boosting voltage to one terminal of a light-emitting element, a voltage comparison circuit unit configured to compare a voltage applied to the other terminal of the light-emitting element with a predetermined reference voltage value and output a comparison result as a feedback signal reflecting the boosting voltage to the power source circuit unit, a driving circuit unit connected to the other terminal of the light-emitting element and configured to supply drive current to the light-emitting element, an acquisition unit configured to acquire a PWM signal, which is generated based on the content of a video signal and can be used to change the luminance of the light-emitting element, and a time-averaging circuit unit configured to output a time-averaged signal of the acquired PWM signal as a control signal to be supplied to the driving circuit unit.

BEST MODE FOR CARRYING OUT THE CLAIMED INVENTION

An embodiment of the present invention is described below with reference to the drawings. A light-emitting element according to the embodiment is, for example, usable as a backlight of a liquid crystal display device, and can be used for any other display apparatus incorporating a light-emitting element whose luminance can be changed.

Figure 1:
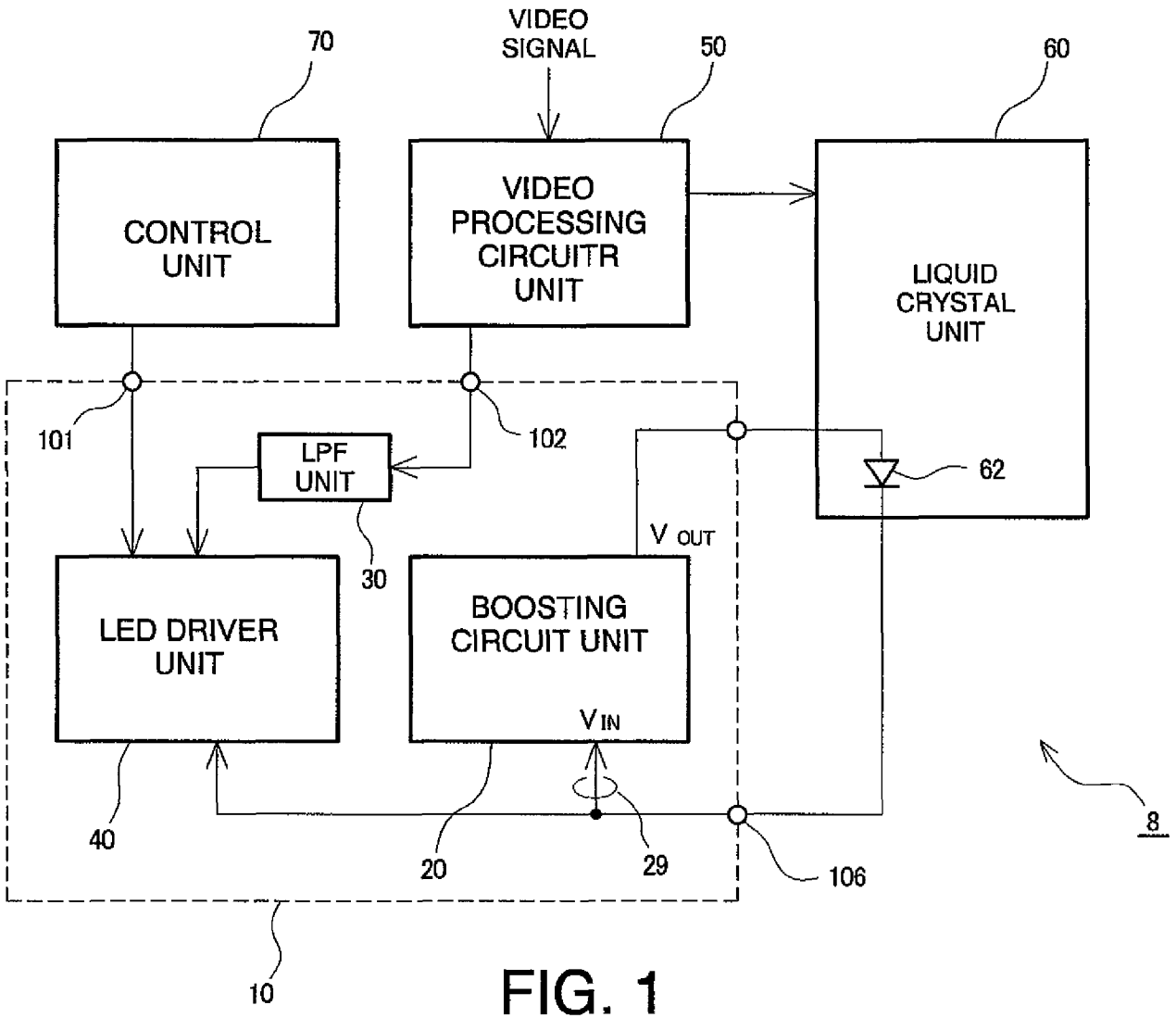
FIG. 1 is a block diagram illustrating a liquid crystal backlight luminance adjusting system incorporating a light-emitting element driving circuit according to an embodiment of the present invention.
Figure 2:
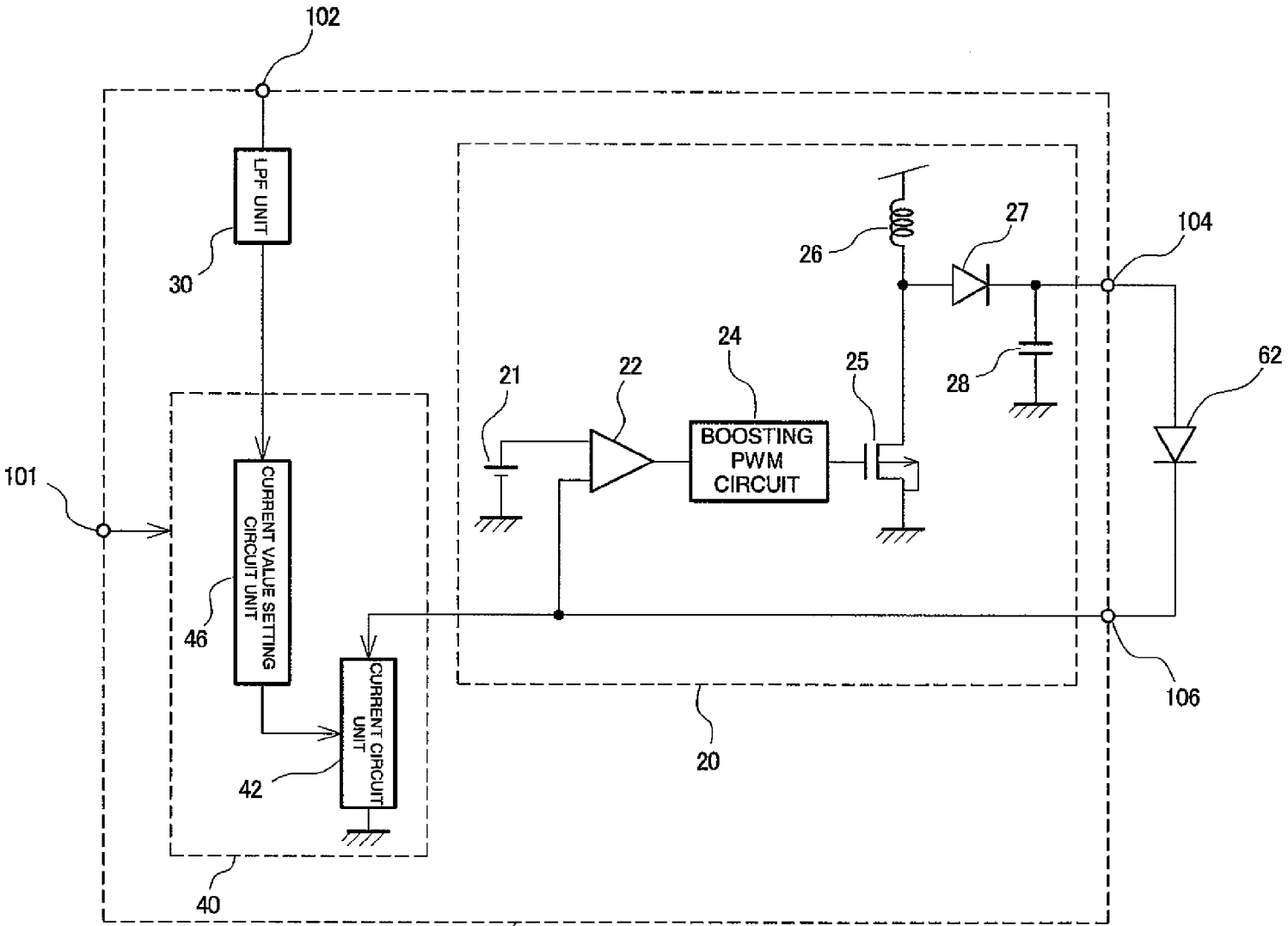
FIG. 2 illustrates a light-emitting element driving circuit unit according to an embodiment of the present invention.

FIG. 1 illustrates a liquid crystal backlight luminance changing system 8. FIG. 2 illustrates a light-emitting element driving circuit unit 10. The liquid crystal backlight luminance changing system 8 includes a liquid crystal unit 60, a video processing circuit unit 50, a control unit 70, and the light-emitting element driving circuit unit 10. The liquid crystal backlight luminance changing system 8 has a function of changing the luminance of a backlight 62 of the liquid crystal display device according to the content of a video signal.

The liquid crystal unit 60 is an image display apparatus incorporating liquid crystal elements. The liquid crystal unit 60 includes the backlight 62, the liquid crystal elements (not illustrated), and polarizing filters (not illustrated). The liquid crystal unit 60 is configured to display an image by transmitting or shielding the light emitted from a light source of the backlight 62.

The backlight 62 is a light-emitting element, which can emit light when a predetermined voltage is applied in a forward direction between a cathode (negative electrode) and an anode (positive electrode). In general, the ON voltage of the backlight 62 is set to 3.6 V or its vicinity. However, the ON voltage is variable depending on process differences. The luminance of the backlight 62 is adjustable by changing the current flowing through the backlight 62.

The video processing circuit unit 50 has a function of processing a video signal (e.g., a broadcasting signal) and supplying a processed signal to the liquid crystal unit 60. Furthermore, the video processing circuit unit 50 has a function of generating a pulse width modulation (PWM) signal, as a luminance adjustment signal corresponding to the content of the video signal, and supplying the generated PWM signal to the light-emitting element driving circuit unit 10. More specifically, the PWM signal according to the content of the video signal is a signal to be used to increase the luminance of the backlight 62 if an image to be expressed is a bright image and decrease the luminance of the backlight 62 if an image to be expressed is a dark image. The video processing circuit unit 50 is electrically connected to the liquid crystal unit 60 and the light-emitting element driving circuit unit 10. The PWM signal to be used in the luminance change adjustment can be referred to as a luminance PWM signal.

The control unit 70 is a microcomputer, which can control the light-emitting element driving circuit unit 10. The control unit 70 can communicate with the light-emitting element driving circuit unit 10 using a serial signal. The control unit 70 is electrically connected to an LED driver unit 40 of the light-emitting element driving circuit unit 10.

The light-emitting element driving circuit unit 10 includes the LED driver unit 40, a boosting circuit unit 20, and a low pass filter (LPF) unit 30. The light-emitting element driving circuit unit 10 has a function of converting the luminance PWM signal generated from the video processing circuit unit 50 into a time-averaged signal (i.e., a luminance PWM signal averaged temporally) and adjusting the luminance of the light-emitting element according to the time-averaged signal.

The LPF unit 30 is a time-averaging circuit unit configured to receive the luminance PWM signal from the video processing circuit unit 50 and output the time-averaged luminance PWM signal. The LPF unit 30 can be, for example, constituted by a low-pass filter including appropriate circuit elements (e.g., a capacitor and a resistor). The LPF unit 30 is electrically connected to the video processing circuit unit 50 and the LED driver unit 40. The luminance PWM signal fluctuates between high and low levels with a duty ratio that varies according to the input video signal. If the luminance PWM signal is directly input to the LED driver unit 40, a significant amount of noise will be generated in the light-emitting element driving circuit unit 10. An aluminum wiring or any other shielding member surrounding the signal line transmitting the luminance PWM signal is generally required to suppress generation of noise. However, the present embodiment does not require such a noise reduction member because the LPF unit 30 supplies the time-averaged signal to the LED driver unit 40.

The LED driver unit 40 is a driving circuit including a current circuit unit 42 and a current value setting circuit unit 46. The LED driver unit 40 has a function of controlling the current flowing through the light-emitting element to have a predetermined target value corresponding to the time-averaged signal. The LED driver unit 40 is electrically connected to the control unit 70, the LPF unit 30, and the cathode terminal of the backlight 62 of the liquid crystal unit 60.

The current circuit unit 42 is a current-mirror circuit supplying current having a current value determined by the current value setting circuit unit 46 to the backlight 62. The current circuit unit 42 has one end electrically connected to cathode terminal of the backlight 62 and the other end electrically connected to the current value setting circuit unit 46.

The current value setting circuit unit 46 has a function of obtaining a current value corresponding to the value output from the LPF unit 30 and setting a current value to be supplied to the current circuit unit 42. The current value setting circuit unit 46 is electrically connected to the LPF unit 30 and the current circuit unit 42. A detailed configuration of the current value setting circuit unit 46 is described below with reference to FIG. 3.

The boosting circuit unit 20 includes a boosting comparator 22, a boosting PWM circuit 24, a boosting transistor 25, a boosting coil 26, a boosting diode 27, and a boosting capacitor 28. The boosting circuit unit 20 is electrically connected to the anode terminal and the cathode terminal of the backlight 62. The boosting circuit unit 20 has a function of performing boosting based on the voltage applied to the cathode terminal and supplying the boosted voltage to the anode terminal. The boosting circuit unit 20 is electrically-connected to the current circuit unit 42 and the backlight 62.

The boosting comparator 22 is a circuit element configured to compare two input voltages and generate an output signal representing an amplified difference between the compared input voltages. The boosting comparator 22 has one input terminal receiving a reference voltage supplied from a reference power source 21 having, for example, an electrical potential of 0.2 V. The boosting comparator 22 has the other input terminal receiving a feedback signal 29 supplied from the cathode terminal of the backlight 62. The boosting comparator 22 compares the electrical potential of the cathode terminal of the backlight 62 with the reference voltage. The boosting PWM circuit 24 receives a comparison signal output from the boosting comparator 22.

The boosting PWM circuit 24 is a modulation circuit, which operates according to a modulation method including changing the duty ratio of a pulse wave. More specifically, the boosting PWM circuit 24 has a function of changing the duty ratio of the pulse wave based on a comparison result received from the boosting comparator 22, and performing switching control for the boosting transistor 25 using the pulse wave reflecting the comparison result.

The boosting transistor 25 is a metal oxide semiconductor (MOS) transistor, which can control the current flowing between source and drain terminals based on a principle that when a voltage is applied to its gate electrode the field of a channel provides a gate in the flow of electrons or holes. The switching control of the boosting transistor 25 is performed when the pulse wave is applied from the boosting PWM circuit 24 to its gate electrode. The gate electrode of the boosting transistor 25 is electrically connected to an output terminal of the boosting PWM circuit 24. The drain electrode of the boosting transistor 25 is electrically connected to the boosting coil 26 and the anode electrode of the boosting diode 27. The source electrode of the boosting transistor 25 is grounded.

The boosting coil 26 has one end receiving a power source voltage of the light-emitting element driving circuit unit 10 and the other end connected to the drain electrode of the boosting transistor 25 and the anode electrode of the boosting diode 27. When the boosting transistor 25 is in an ON state, the power source voltage is applied to the boosting coil 26, and energy is stored in the boosting coil 26.

The boosting diode 27 is a circuit element having a rectifying function (i.e., a function of regulating the current to flow in a predetermined direction). When the boosting transistor 25 is in an OFF state, the energy stored in the boosting coil 26 (which functions as a voltage source) is supplied as current to a load via the boosting diode 27. The anode electrode of the boosting diode 27 is electrically connected to the boosting coil 26 and the boosting transistor 25.

The boosting capacitor 28 is a circuit element having a capacitance, which can store and discharge electric charge (electric energy). The boosting capacitor 28 has a function of storing electric charge supplied from the boosting coil 26 when the boosting transistor 25 is in the OFF state. The boosting capacitor 28 has one end electrically connected to the cathode electrode of the boosting diode 27 and the anode electrode of the backlight 62. The other end of the boosting capacitor 28 is grounded.

Figure 3:
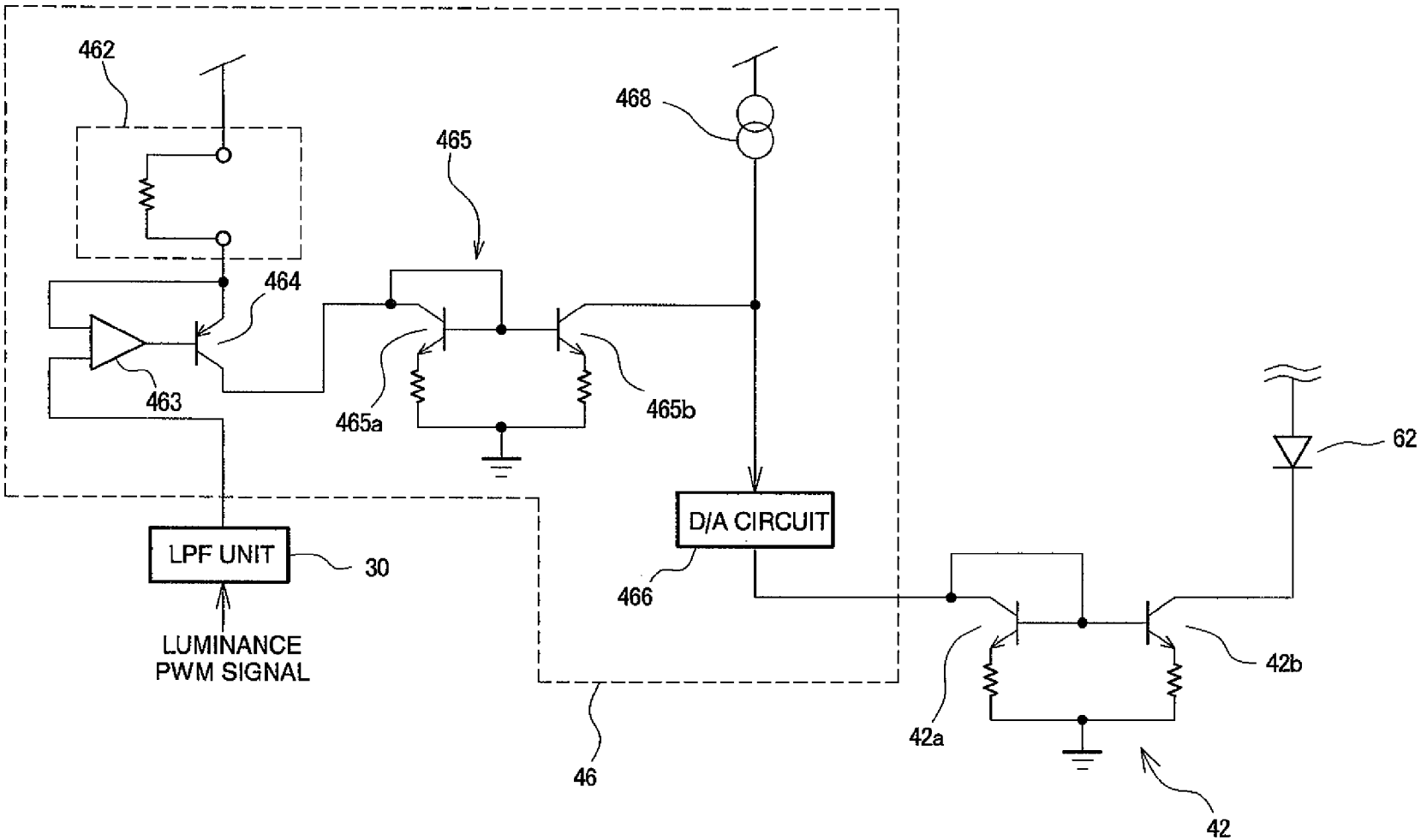
FIG. 3 illustrates a current value setting circuit unit and a peripheral circuit which are connected to each other.

FIG. 3 illustrates the current value setting circuit unit 46 and a peripheral circuit, which are connected to each other. The current value setting circuit unit 46 includes a DC side resistor 462, a DC side comparator 463, a DC side transistor 464, a DC side current-mirror circuit 465, a reference current source 468, and a D/A circuit 466.

The DC side resistor 462 is a circuit element capable of suppressing the flow of current. The DC side resistor 462 has one end connected to a voltage source supplying a voltage corresponding to a high level of the luminance PWM signal and the other end connected to the DC side comparator 463 and the DC side transistor 464. The DC side resistor 462 has a function of dividing a voltage corresponding to the high level of the luminance PWM signal and supplying a divided voltage, as a DC side reference voltage, to the DC side comparator 463. The DC side resistor 462 is an external circuit element provided on a semiconductor substrate, on which the light-emitting element driving circuit unit 10 is also mounted. The DC side resistor 462 has a resistance value that is variable, if necessary, to change the current value flowing through the DC side transistor 464.

The DC side comparator 463 compares the above-described DC side reference voltage with the voltage generated from the LPF unit 30 and generates an output signal representing a comparison result. The DC side transistor 464 receives the output signal of the DC side comparator 463.

The DC side transistor 464 has an electrode electrically connected to the DC side resistor 462, an electrode electrically connected to the DC side current-mirror circuit 465, and an electrode electrically connected to the DC side comparator 463. Current, corresponding to the output voltage of the DC side comparator 463, flows through the DC side transistor 464. In other words, the current flowing through the DC side transistor 464 is PWM current, which corresponds to the luminance PWM signal. The DC side transistor 464 can be a bipolar transistor or a MOS transistor.

The DC side current-mirror circuit 465 includes a left-hand transistor 465*a* and a right-hand transistor 465*b*, according to which current flowing through the left-hand transistor 465*a* is equal to current flowing through the right-hand transistor 465*b*. When the DC side transistor 464 is in an ON state, PWM current identical in value to that flowing through the left-hand transistor 465*a* flows through the right-hand transistor 465*b* in the DC side current-mirror circuit 465.

The reference current source 468 is a current source capable of supplying constant current having a predetermined current value. The reference current source 468 has one end connected to a terminal to which a predetermined power source voltage is applied and the other end electrically connected to the D/A circuit 466 and the DC side current-mirror circuit 465.

The D/A circuit 466 converts a digital signal into an analog signal. The D/A circuit 466 receives the current supplied from the reference current source 468, which has a current value subtracted by the DC side current-mirror circuit 465. The D/A circuit 466 converts the input current value into an analog signal, and supplies the analog signal to the current circuit unit 42.

The above-described liquid crystal backlight luminance changing system 8 has the following functions. First, the video processing circuit unit 50 generates a luminance PWM signal corresponding to the content of a video signal. The luminance PWM signal is supplied to the LPF unit 30, which generates a time-averaged signal of the luminance PWM signal. The DC side comparator 463 compares the time-averaged signal generated from the LPF unit 30 with the DC side reference voltage divided by the DC side resistor 462, and generates a voltage signal representing the difference of the compared voltages. The current corresponding to the voltage signal generated by the DC side comparator 463 flows through the DC side transistor 464.

Then, the current flows through the left-hand transistor 465*a* and the right-hand transistor 465*b* of the DC side current-mirror circuit 465. The reference current supplied from the reference current source 468 is subtracted by the current flowing through the DC side current-mirror circuit 465 and is supplied to the D/A circuit 466. The current signal is converted by the D/A circuit 466 into an analog signal. The current corresponding to the analog signal flows through the current circuit unit 42, which drives the backlight 62. In this manner, the luminance of the backlight can be changed based on the luminance PWM signal.

The boosting comparator 22 compares the voltage applied to the cathode terminal of the backlight 62 with the reference voltage (e.g., 0.2 V) supplied from the reference power source 21. Then, the boosting comparator 22 generates an output signal representing a comparison result. The boosting PWM circuit 24 generates a boosting PWM signal (i.e., a PWM signal to be used for boosting) according to the output signal supplied from the boosting comparator 22. The boosting transistor 25 is ON/OFF controlled based on the boosting PWM signal. When the boosting transistor 25 is in the ON state, energy is stored in the boosting coil 26. If the boosting transistor 25 is turned off, the energy stored in the boosting coil 26 is supplied to the boosting capacitor 28 via the boosting diode 27 so as to charge the boosting capacitor 28. The electric charge stored in the boosting capacitor 28 can be used to boost the voltage applied to the anode terminal of the backlight 62.

As the LED driver unit 40 receives the time-averaged signal from the LPF unit 30, it is unnecessary to provide an aluminum wiring surrounding the signal line transmitting the PWM signal or any other shielding member to suppress generation of noise. Moreover, as the LED driver unit 40 receives the time-averaged signal from the LPF unit 30, the backlight 62 does not repeat turning on/off in response to the luminance PWM signal. The liquid crystal display device does not cause any undesirable fluctuation on a displayed image.

According to the above-described embodiment, the boosting circuit unit 20 includes the boosting comparator 22, the boosting PWM circuit 24, the boosting transistor 25, the boosting coil 26, the boosting diode 27, and the boosting capacitor 28. However, the boosting circuit unit 20 can include any other circuit having a boosting function, such as a charge pump circuit. Even in such a case, the time-averaged signal can be input from the LPF unit 30 to the LED driver unit 40. Therefore, it is unnecessary to provide an aluminum wiring surrounding the signal line transmitting the PWM signal or any other shielding member to suppress generation of noise.

According to the above-described embodiment, the boosting circuit unit 20 functions as a boosting circuit performing boosting based on the feedback signal 29 supplied from the cathode terminal of the backlight 62. However, the boosting circuit unit 20 can be configured as an open-loop boosting circuit that does not input the feedback signal 29. Even in such a case, the time-averaged signal can be input from the LPF unit 30 to the LED driver unit 40. Therefore, it is unnecessary to provide an aluminum wiring surrounding the signal line transmitting the PWM signal or any other shielding member to suppress generation of noise. Moreover, as the LED driver unit 40 receives the time-averaged signal from the LPF unit 30, the backlight 62 does not repeat turning on/off in response to the luminance PWM signal. The liquid crystal display device does not cause any undesirable fluctuation on a displayed image.

What is claimed is:

1. A light-emitting element driving circuit comprising:

a boosting circuit unit configured to supply a boosting voltage to one terminal of a light-emitting element in response to a comparison result obtained by the boosting circuit unit comparing a voltage applied to the other terminal of the light-emitting element with a predetermined reference voltage value;

a driving circuit unit connected to the other terminal of the light-emitting element and configured to supply drive current to the light-emitting element;

an acquisition unit configured to acquire a PWM signal, which is generated based on the content of a video signal and can be used to change the luminance of the light-emitting element; and a time-averaging circuit unit configured to output a time-averaged signal of the acquired PWM signal as a control signal to be supplied to the driving circuit unit, wherein the other terminal of the light-emitting element is a cathode electrode, and wherein the drive current supplied from the driving circuit unit to the light-emitting element has a current value obtained by subtracting a current value derived from the time-averaged signal from a predetermined reference current value;

the light-emitting element driving circuit further comprising:

a semiconductor chip; and a resistor element disposed on the semiconductor chip as an external circuit element, wherein the resistor element has a resistance value that can be used to set the current value derived from the time-averaged signal.

2. A light-emitting element driving circuit comprising:

a boosting circuit unit configured to supply a boosting voltage to one terminal of a light-emitting element in response to a comparison result obtained by the boosting circuit unit comparing a voltage applied to the other terminal of the light-emitting element with a predetermined reference voltage value;

a voltage comparison circuit unit configured to compare a voltage applied to the other terminal of the light-emitting element with a predetermined reference voltage value, and output a comparison result as a feedback signal reflecting the boosting voltage to the power source circuit unit;

a driving circuit unit connected to the other terminal of the light-emitting element and configured to supply drive current to the light-emitting element;

an acquisition unit configured to acquire a PWM signal, which is generated based on the content of a video signal and can be used to change the luminance of the light-emitting element; and a time-averaging circuit unit configured to output a time-averaged signal of the acquired PWM signal as a control signal to be supplied to the driving circuit unit, wherein the other terminal of the light-emitting element is a cathode electrode, and wherein the drive current supplied from the driving circuit unit to the light-emitting element has a current value obtained by subtracting a current value derived from the time-averaged signal from a predetermined reference current value;

the light-emitting element driving circuit further comprising:

a semiconductor chip; and a resistor element disposed on the semiconductor chip as an external circuit element, wherein the resistor element has a resistance value that can be used to set the current value derived from the time-averaged signal.

* * * * *